US005269416A

United States Patent [19]

DeMatteis

[11] Patent Number: 5,269,416

[45] Date of Patent: Dec. 14, 1993

[54] RACK FOR DISPENSING DUAL TAB MERCHANDISING BAG

[75] Inventor: Robert B. DeMatteis, Colton, Calif.

[73] Assignee: Polytec Packaging, La Mirada, Calif.

[21] Appl. No.: 814,785

[22] Filed: Jan. 8, 1992

[51] Int. Cl.[5] ..... A47F 13/08

[52] U.S. Cl. ..... 211/50; 221/61; 211/59.1; 248/95

[58] Field of Search ..... 211/59.1, 50, 49.1, 211/86; 248/95, 101; 206/DIG. 80, 554; 383/9, 37; 221/26, 92; 312/34.4, 189; 186/66

[56] References Cited

U.S. PATENT DOCUMENTS

| | | | |
|---|---|---|---|
| 2,314,473 | 3/1943 | Barlow | 211/50 |
| 3,646,723 | 3/1972 | Meroney | 383/9 X |
| 3,918,589 | 11/1975 | Nausedar | 221/26 |
| 4,062,170 | 12/1977 | Orem | 186/66 X |
| 4,085,822 | 4/1978 | Osborn | 186/66 |
| 4,155,458 | 5/1979 | Moline | 211/59.1 X |
| 4,537,330 | 8/1985 | Gelbard | 221/26 |
| 4,787,522 | 11/1988 | Nocek et al. | 248/95 X |
| 4,932,560 | 6/1990 | Roen | 221/26 |
| 4,981,216 | 1/1991 | Wilfong, Jr. | 383/9 X |
| 5,160,103 | 11/1992 | Breitonstein | 248/100 |

*Primary Examiner*—David A. Scherbel
*Assistant Examiner*—Korie H. Chan
*Attorney, Agent, or Firm*—Townsend and Townsend

[57] ABSTRACT

A rack for the counter suspension of various packets of dual tab merchandising bags, which includes a depending panel supported from the top. The depending panel has a front plane surface interrupted with a plurality of bag dispensing apertures. The rear and counter exposed side of each aperture has a short horizontal shelf which protrudes away from the front of the panel. The shelf includes two stanchions, one at each side of the shelf.

16 Claims, 3 Drawing Sheets

RACK FOR DISPENSING DUAL TAB MERCHANDISING BAG

This invention relates to a rack for dispensing dual tab merchandising bags. Specifically, a rack is disclosed which is capable of disposing depending bag packets to the tactile location of a clerk for immediate singulation and dispensing of the bags in the open position.

BACKGROUND OF THE INVENTION

Merchandise is usually sold to a consumer by a clerk. Usually, this clerk works across a counter, the counter intervening between the customer on one side and the clerk on the other side. Since the customer (and the displayed merchandise) have priority, it is the usual practice that the counter area occupied by the clerk is small.

Bags for carrying the merchandise are usually kept in containers on the clerk side of the counter. Typically, the bags are under such counters. The problem with this practice is that typically, these containers of bags take up most of what little space is available under the cramped and already crowded counter space. This crowded counter space is aggravated by the requirement that bags of various sizes be available.

When bags of differing sizes are required, the process of finding the appropriate size bag is difficult and time consuming. First, the appropriate container must be located. Since the containers are individually moveable, their location is not certain.

Another problem with dispensing bags from containers is that singulation of a bag from the rest of the packet is frequently difficult, especially when the container from which the singulation must occur is a moveable carton contained under a crowded counter shelf. The bags, when manufactured, are usually packed tightly inside the dispensing which creates a definite tendency for the bags to stick together. The clerk will often pull more than one bag from the dispenser container, when only one is needed. Invariably, the unsuccessfully separated bags which are withdrawn from the dispensing container are pulled out of their original planar alignment as in the situation where the clerk pulls the wrong size. The wastage that occurs due to this common occurrence is substantial.

SUMMARY OF THE INVENTION

A rack for the counter suspension of various packets of bags in close proximity to the side of a sales counter is disclosed. Various sizes of depending bag packets are disposed for the tactile location of the desired size of bag by the clerk for immediate singulation and dispensing of the bags in the open position.

The bags in the suspended packet are the so-called "dual tab merchandising bags" having many bags stacked in overlying relation one upon another. Each tubular bag has a front and rear panels with "W" folded gusset sides and an open and severed top and a sealed and severed bottom. The front and rear panels at the open top define bag handles apertures and have bag supporting tabs at both sides adjacent the top.

The rack includes a depending panel supported at the top and hanging downward from a support. Suspension is usually in close fitting relationship over a cabinet front or wall in the otherwise small sales counter area occupied by the clerk. The rack is spatially separated from the counter to enable the rack to accommodate on its reverse side the needed inventory of small, medium and large bags.

On the clerk exposed side of the rack, the rack is flush presenting an otherwise plane surface. This plane surface is interrupted with a series of bag dispensing apertures, usually three apertures—two upper side-by-side small and medium apertures, and one underlying and centered large aperture.

Each of the apertures includes an arcuate upper border for the centering of the hand to the aperture on a tactile basis. The rear and counter exposed side of each aperture has a short horizontal shelf which protrudes away from the front of the panel and rearward to and toward the cabinet or wall. Each shelf—having roughly the width its particular aperture includes a flat surface with a rear and downward extending lip and two stanchions, one at each shelf side, half way between the front and the rear of the shelf. These stanchions are for registry to the tabs and have at their upper extremity stops. The preferred stops of this invention are horizontally bent portions of the stanchions extending away from the front opening of the panel.

For loading a packet of bags to each aperture, the rack is typically removable from its support. When the rack is removed, it is placed front panel down on a supporting surface, usually the counter, so that the shelves and stanchions are supported and exposed to a packet of bags to be loaded. A packet of bags is typically grasped by the clerk at each tab, draped over the protruding shelf, and threaded at central apertures in the tab first over the stanchion stop and secondly along the stanchion length until the bag packet at the tab is flush to the shelf. The otherwise depending mass of each bag packet is draped along the rear surface of the rack. When all apertures and shelves are loaded, the rack is picked up from its horizontal disposition and dependingly hung from its support. It is thus disposed in close proximity to a cabinet or wall in the sales counter area occupied by the clerk. The bulk of the bag packets dependingly hang behind the rack where they do not otherwise interfere with the movement of the clerk and can be individually dispensed without interference.

Bag singulation and dispensing from the rack occurs from the bag packets in their depending suspension from the rack. This process normally includes tactile location of the aperture corresponding to the size of bag desired. The bag is grasped on the upwardly exposed front panel of the top bag in each bag packet by the hand of the clerk.

Thereafter, the upwardly exposed front surface of the bag is grasped at the handle aperture and pulled outwardly from the rack. This pulling confines the bag passage between the stanchions, these stanchions having a separation less than the total width of the bag. This confined passage of the bag combined with a preferred bag construction at the bag tabs set forth in co-pending U.S. patent application Ser. No. 07/776 920, entitled Self Opening Dual Tab Merchandising Bag, filed Oct. 15, 1991, serially separates each side of the bag from the tabs. This serial separation causes first the front bag panel at the front handle aperture to be dispensed followed finally by the rear bag panel and rear handle aperture. Singulation and opening of a tactilely located bag from the relatively crowded clerk occupied side of a sales counter occurs.

One of the objectives of this invention is to minimize the space necessary for storing bags used in the sale of merchandise. In addition, the ease in which the rack can be loaded with packets of bags makes the rack simple and easy to use.

Another objective of this invention is that the rack will enable dual tab merchandising bags to be easily and effectively dispensed, thereby resulting in successful singulation which will eliminate the wastage of bags and time associated with the prior method for dispensing bags.

Other features and advantages of the invention will appear from the following description in which the preferred embodiment has been set forth in detail in conjunction with the accompanying drawings.

DESCRIPTION OF THE PREFERRED EMBODIMENT

Figure 1:
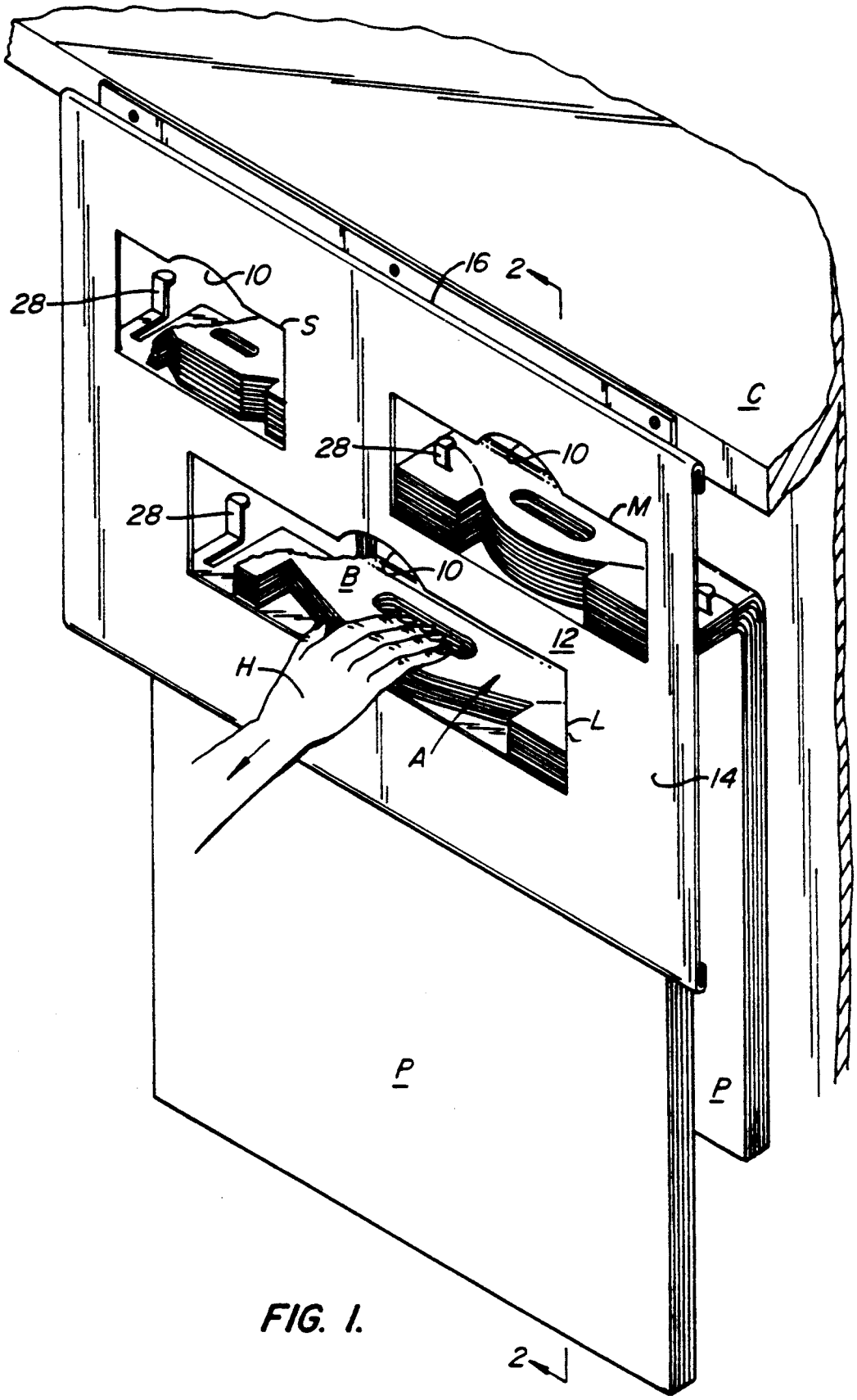
FIG. 1 is a frontal view of a rack for dispensing dual tab merchandising bags according to the present invention.
Figure 2:
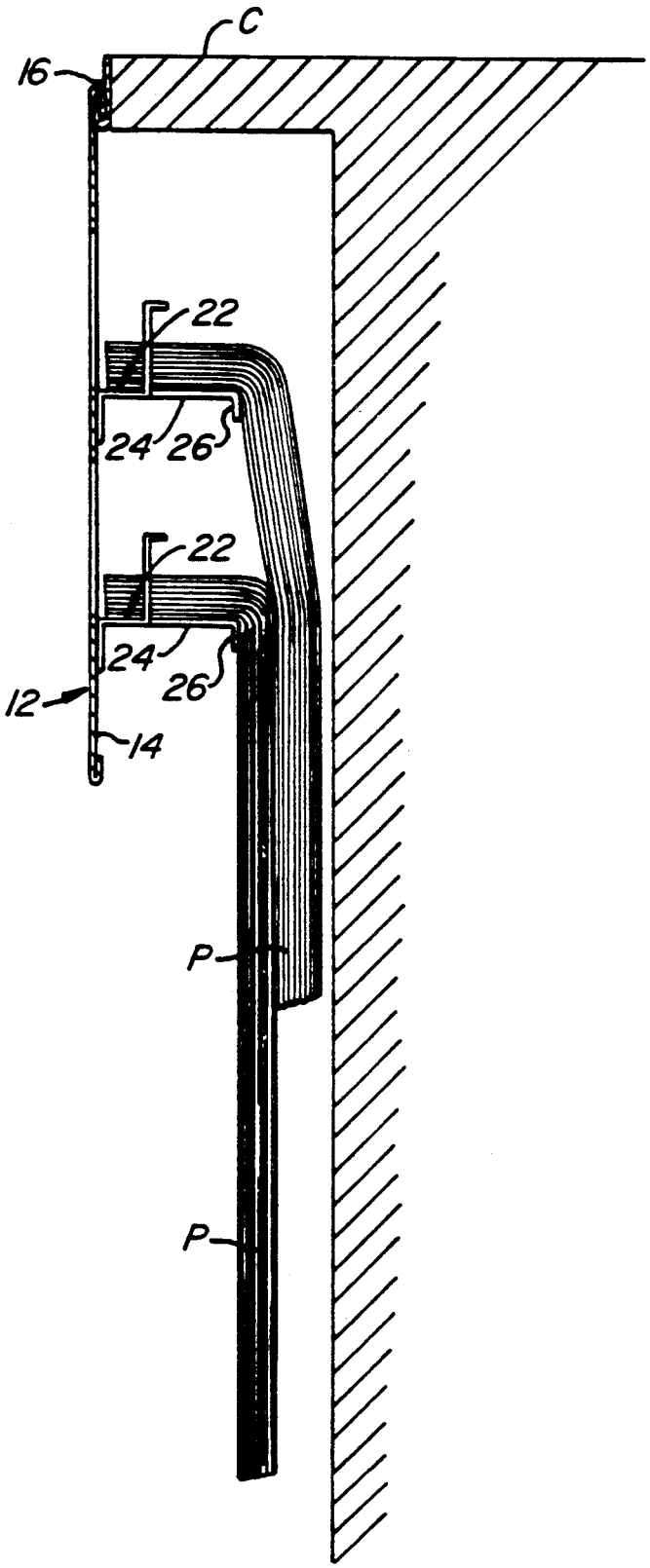
FIG. 2 is a side view of the rack of FIG. 1 that is loaded with dual tab merchandising bags.
Figure 3:
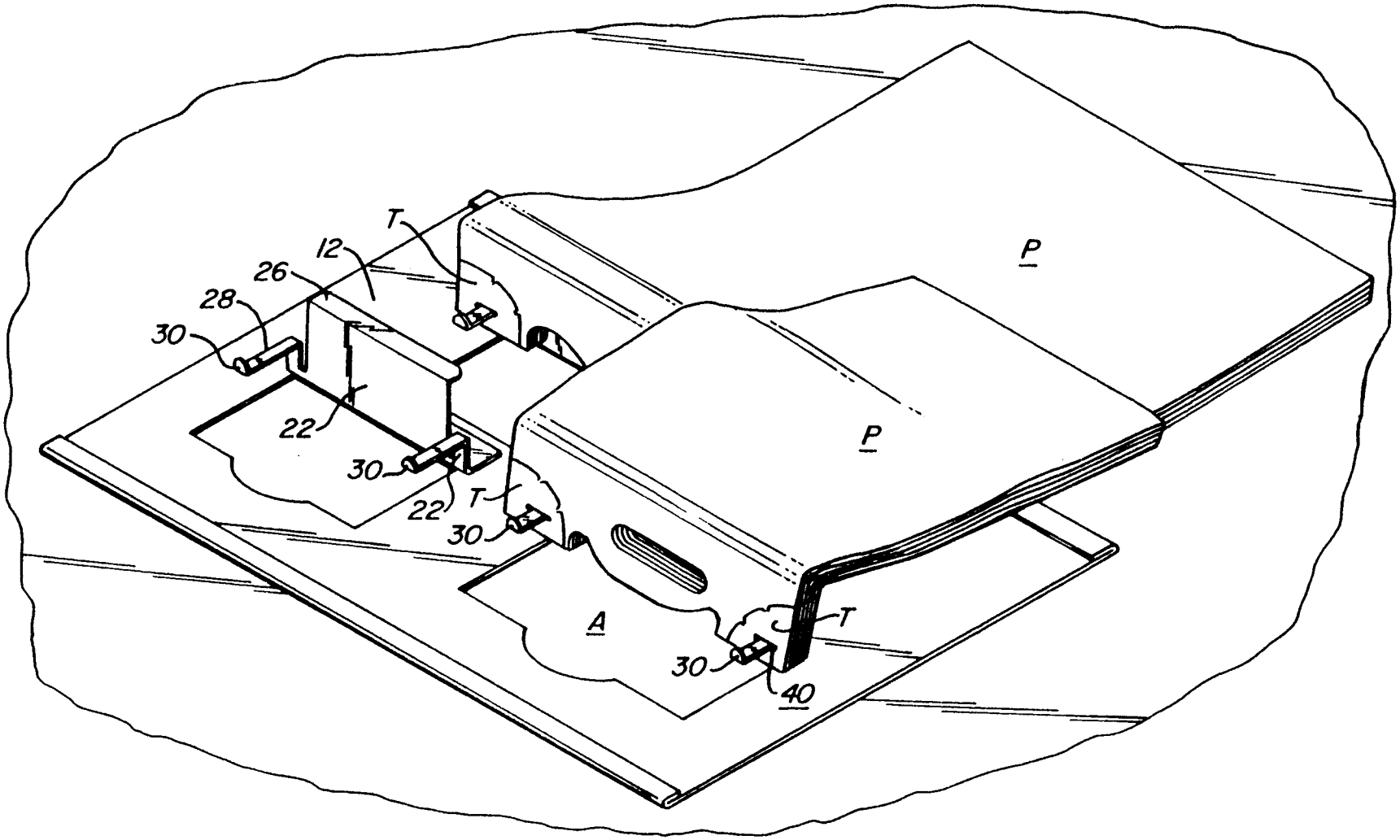
FIG. 3 is a perspective view of the backside of the rack of FIG. 1 partially loaded with dual tab merchandising bags.

FIGS. 1, 2 and 3 show a rack 12 for the counter suspension of various packets of dual tab merchandising bags. Referring to FIGS. 1 and 2, a rack 12 is shown mounted in close proximity to the side of a sales counter for disposing depending bag packets P to the tactile location of a clerk's hand H for immediate singulation and dispensing of the bags in the open position.

The rack 12 includes a depending panel 14 supported at the top 16 and hanging downward from the support typically in close fitting relationship over a cabinet front C in sales counter area occupied by the clerk. On the clerk exposed side of rack 12, the rack is flush presenting an otherwise plane front surface. The plane front surface is interrupted with a series of bag dispensing apertures, usually three apertures—two upper side-by-side small and medium apertures, S and M respectively, and one underlying and centered large aperture L.

Each of the apertures includes an arcuate upper border 10 for the centering of the hand to the aperture on a tactile basis. The rear and counter exposed side of each aperture has a short horizontal shelf 22 which protrudes away from the front of the panel and rearward to and toward the cabinet or wall. The shelf, having roughly the width of the aperture, includes a flat surface 24 with a rear and downward extending lip 26 and two stanchions 28, located in the middle of the depth of the shelf, one at each shelf side. Stanchions 28 are for registry to the tabs and have at their upper extremity stops 30, stops 30 being bent horizontally away from the depending panel.

Referring to FIG. 3, the process for loading bag packet P to each aperture A. Panel 14 is typically placed with front surface down on a supporting surface so that shelves 22 and stanchions 28 are supported and exposed to bag packet P to be loaded. Bag packet P is grasped by the clerk at each tab T, draped over shelf 22, and threaded at central apertures 40 in tabs T first over stanchion stops 30 and secondly along stanchions 28 length until the tab is flush to flat surface 24 of shelf 22. The otherwise depending mass of each bag packet is draped along extending lip 26. When all apertures A and shelves 22 are loaded, panel 14 is picked up from its horizontal disposition and dependingly hung from a cabinet or wall in the sales counter area occupied by the clerk. When the rack is in place, the bag packets dependingly hang from the rack.

Referring back to FIG. 1, bag singulation and dispensing from bag packets P in their depending suspension from rack 12 is illustrated. This process normally includes tactile location of an aperture A by the clerk's hand H—these apertures being selected from the exposed small, medium or large apertures, S, M and L respectively—exposing at the top of the bag packet P a bag B corresponding to the size of bag the clerk wishes to dispense.

This invention finds preferred use with that bag construction set forth in my co-pending U.S. patent application Ser. No. 07/776,920 entitled Self Opening Dual Tab Merchandising Bag, filed Oct. 15, 1991. In this disclosure, I and my co-inventor Ralph Schlender set forth a bag construction that singulates in the open position when dispensed so that "bagging" of merchandise can immediately occur. When this invention is combined with the disclosed rack, a "bagging" system is provided where a clerk can place purchased items within a dispensed bag without diverting his attention to either the bag or the item within the bag. Accordingly, full attention can be devoted to the customer and the sale transaction without diversion to singulation of the bag, opening of the bag, and the placement of the merchandise—especially the first item—in the bag.

What is claimed is:

1. A rack for the counter suspension of dual tab merchandising bag packets in close proximity to the vertical side of a sales counter for disposing vertically depending bag packets to the tactile location of a clerk for immediate singulation and dispensing of the bags in the open position comprising in combination:

a panel for support in close fitting relationship over a vertical side of a sales counter area occupied by the clerk, said panel having a first side exposed to a clerk in said sales counter, said first side being flush and presenting an otherwise plane surface, said panel having a second side exposed to the vertical side of said sales counter;

a support for said panel having means for mounting to said sale counter area with said second side spaced apart from the vertical side of said sales counter;

said panel defining in said plane surface at least one bag dispensing aperture;

a horizontal shelf commencing at said aperture and extending away from the second side of said panel and rearward toward the vertical side of said sales counter said shelf having a shelf end parallel to the surface of said panel, said shelf end located a distance from the panel less than the spacial separation of said panel from the vertical side of said sales counter;

two stanchions, one at each shelf side;

a suspended packet of dual tab merchandising bags having a plurality of bags stacked in overlying relation one upon another with dual tabs defined at each corner of said stacked bags, each said tab defining a common aperture for the support of said bags, said suspended packet of dual tab merchandising bags fitting over said shelf end between said shelf end and the vertical side of said sales counter;

each said bag in each said packet including:

a tubular bag having a front and rear panels with an open and severed top and a sealed and severed bottom whereby singulation and opening of a tactilely located bag from the relatively crowded clerk occupied side of a sales counter can occur.

2. The rack of claim 1 and wherein:

said panel is configured for depending support from said sales counter;

means for mounting to said sales counter for dependingly supporting said panel.

3. The rack of claim 1 and wherein said panel defines three apertures; said apertures including two upper side-by-side small and medium apertures, and one underlying and centered large aperture.

4. The rack of claim 1 and wherein said aperture includes an arcuate upper border for the centering of the hand of said clerk to the aperture on a tactile basis.

5. The rack of claim 1 and wherein said shelf extends substantially the width of the aperture and defines a flat surface terminating at the shelf end away from said panel with a rear and downward extending lip.

6. The rack of claim 1 and wherein said stanchions is located in the middle of the depth of the shelf, said stanchions for registry to tabs of said dual tab merchandising bag packets.

7. The rack of claim 1 and wherein said stanchions include at their upper extremity stanchion stops for capturing said tabs of said dual tab merchandising bag packets.

8. The rack of claim 7 and wherein said stops comprise portions of said stanchions bent horizontally away from the front surface of the panel.

9. The rack of claim 1 and wherein each said bag in said bag packet includes W folded gusset sides.

10. The rack of claim 1 and wherein each said bag in said bag packet includes said front and rear panels defining at the open top bag handles apertures and having bag supporting tabs at both sides adjacent the top.

11. A rack for the counter suspension of dual tab merchandising bag packets in close proximity to the vertical side of a sales counter for disposing depending bag packets to the tactile location of a clerk for immediate singulation and dispensing of the bags in the open position, said bag packets including a packet of dual tab merchandising bags having a plurality of bags stacked in overlying relation one upon another with dual tabs defined at each corner of said stacked bags, each said tab defining a common aperture for the support of said bags; each said bag of said packet including a tubular bag having a front and rear panels with an open and severed top and a sealed and severed bottom;

said rack for dispensing bags from said bag packets comprising in combination:

a panel in close fitting relationship over a vertical side of a sales counter area occupied by the clerk, said panel having a first side exposed to a clerk in said sale counter, said first side being flush and presenting an otherwise plane surface, said panel having a second side exposed to the vertical side of said sales counter;

a support for said panel having means for mounting to said sale counter area with said second side spaced apart from the vertical side of said sales counter;

said panel defining in said plane surface at least one bag dispensing aperture;

a horizontal shelf commencing at said aperture and extending away from the second side and toward said vertical side of said sales counter with a shelf end parallel to the surface of said panel, said shelf end located a distance from the panel less than the spacial separation of said panel from the vertical side of said sales counter whereby said packet of dual tab merchandising bag can fit over said shelf end between said shelf end and the vertical side of said sales counter;

two stanchions spaced apart from the panel and each attached, one at respective shelf side for mounting said common aperture of said tabs for the support of said bag packet.

12. The rack of claim 11 and wherein said shelf extends substantially the width of the aperture and defines a flat surface terminating at the shelf end away from said panel with a rear and downward extending lip.

13. The rack of claim 11 and wherein said stanchions is located in the middle of the depth of the shelf, said stanchions for registry to tabs of said dual tab merchandising bag packets.

14. The rack of claim 11 and wherein said stanchions include at their upper extremity stanchion stops for capturing said tabs of said dual tab merchandising bag packets.

15. The rack of claim 14 and wherein said stops comprising portions of said stanchions bent horizontally away from the front surface of the panel.

16. A process for loading a rack for the counter suspension of dual tab merchandising bag packets in close proximity to the vertical side of a sales counter for disposing vertically depending bag packets to the tactile location of a clerk for immediate singulation and dispensing of the bag, said rack including;

a panel for support in close fitting relationship over a vertical side of a sales counter area occupied by the clerk, said panel having a first side exposed to a clerk in said sales counter, said first side being flush and presenting an otherwise plane surface, said panel having a second side exposed to the vertical side of said sales counter;

a support for said panel having means for mounting to said sale counter area with said second side spaced apart from the vertical side of said sales counter;

said panel defining in said plane surface at least one bag dispensing aperture;

a horizontal shelf commencing at said aperture and extending away from the second side of said panel and rearward toward the vertical side of said sales counter, said shelf having a shelf end parallel to the surface of said panel, said shelf end located a distance from the panel less than the spacial separation of said panel from the vertical side of said sales counter;

two stanchions, one at each shelf side;

the process of loading said rack comprising the steps of:

placing the rack with said front panel down on a supporting surface so that said shelves and stanchions are supported and exposed to a packet of dual tab merchandising bags to be loaded;

grasping said packet of bags at each tab;

draping said packet over said horizontal shelf with said packet draped over said shelf end;

threading said packet at central apertures in said tab along said stanchion until said tab is flush to said shelf; and, lifting said loaded rack from its horizontal disposition and dependingly hanging said loaded rack at sales counter area occupied by the clerk.

* * * * *